US006923164B1

(12) United States Patent
Mitsudou et al.

(10) Patent No.: US 6,923,164 B1
(45) Date of Patent: Aug. 2, 2005

(54) FUEL SUPPLY APPARATUS

(75) Inventors: Hideo Mitsudou, Tokyo (JP); Masaru Hiraiwa, Tokyo (JP); Michihiro Hayashi, Tokyo (JP); Seizo Inoue, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 22 days.

(21) Appl. No.: 10/891,063

(22) Filed: Jul. 15, 2004

(30) Foreign Application Priority Data

Jan. 19, 2004 (JP) ..... 2004-010822

(51) Int. Cl.[7] ..... F02M 37/04
(52) U.S. Cl. ..... 123/509; 123/514
(58) Field of Search ..... 123/514, 509, 123/506, 495, 497; 137/565.24, 565.34, 572, 574, 576, 592; 417/53, 360

(56) References Cited

U.S. PATENT DOCUMENTS 4,694,857 A * 9/1987 Harris ..... 137/565.24
4,780,063 A * 10/1988 Tuckey ..... 417/360
5,038,741 A * 8/1991 Tuckey ..... 123/509
5,647,330 A * 7/1997 Sawert et al. ..... 123/509
5,699,773 A * 12/1997 Kleppner et al. ..... 123/510
5,762,049 A * 6/1998 Jones et al. ..... 123/514
6,000,913 A * 12/1999 Chung et al. ..... 417/53
6,029,633 A * 2/2000 Brandt ..... 123/509
6,152,174 A * 11/2000 Hein ..... 137/576
6,360,765 B1 * 3/2002 Pozgainer ..... 137/15.01

* cited by examiner

*Primary Examiner*—Carl S. Miller
(74) *Attorney, Agent, or Firm*—Sughrue Mion, PLLC

(57) ABSTRACT

A fuel supply apparatus capable of following the positional variations of the bottom side of a fuel tank through a simple construction and improved in terms of ease of assembly in the fuel tank. The apparatus includes a fuel pump body in which a filter-integrated pump in which a fuel pump and a fuel filter are integrally formed is integrally accommodated in a fuel reservoir having a bottom capable of coming into abutment with a bottom side of the fuel tank, and causes the fuel pump body to travel to follow the variations of the bottom side of the fuel tank so as to be placed in abutment with the bottom side of the fuel tank, by means of an urging force generated on the basis of the pressure of the fuel inside the fuel pump body.

13 Claims, 10 Drawing Sheets

FUEL SUPPLY APPARATUS

BACKGROUND OF THE INVENTION

1. Field of the Invention

The present invention relates to a fuel supply apparatus which is mounted in a fuel tank and is operative to stably supply fuel to an internal combustion engine, and more particularly, to a fuel supply apparatus of the type in which a fuel pump body is disposed in abutment with the bottom side of the fuel tank.

2. Description of the Related Art

In the field of fuel tanks used for supplying fuel to internal combustion engines such as automotive engines, a fuel supply apparatus has heretofore been known which is constructed to ensure stable operation of a fuel pump even when the liquid level in the fuel pump varies, by making use of a subtank in which the fuel pump is accommodated.

For example, a fuel supply apparatus of the type in which a fuel pump body is mounted on the bottom side of a fuel tank is disclosed in JP-A-11-294282 (Patent Document 1, FIG. 3).

FIG. 12 schematically shows the fuel supply apparatus of Patent Document 1, and this fuel supply apparatus will be described below. Referring to FIG. 12, a filter-integrated pump 103 in which a fuel pump unit 101 and a fuel filter unit 102 are integrally formed is fixedly accommodated integrally with a suction-side filter 104 in a rotary tank 108 having a flat bottom capable of coming into abutment with the bottom side of a fuel tank (not shown), and a rotary-tank mounting wall 122 capable of being fitted into the integrated rotary tank 108 is provided on a fuel tank lid 119 through which a fuel discharge passage portion 120 is inserted. The rotary-tank mounting wall 122 and the rotary tank 108 are expansibly fitted together by an expanding/shortening mechanism 138.

The rotary-tank mounting wall 122 is constructed so that its inside diameter becomes approximately equal to or slightly greater than the outside diameter of the filter-integrated pump 103 and its outside diameter becomes approximately equal to or slightly smaller than the inside diameter of the rotary tank 108, whereby the rotary-tank mounting wall 122 can be inserted into the gap between the filter-integrated pump 103 and the rotary tank 108. In addition, guide tube portions 124 which extend in an axial direction 113 are formed in the inside of the rotary tank 108 at a plurality of circumferential positions thereof, and guide portions 125 capable of being slidably fitted into the respective guide tube portions 124 are formed at the corresponding positions of a side portion of the rotary-tank mounting wall 122. An elastic member 126 such as a coiled spring is interposed between the guide tube portions 124 and the guide portions 125 to expansibly support the rotary-tank mounting wall 122 and the rotary tank 108 by the elastic force of the elastic member 126.

Furthermore, engaging claw portions 127 are respectively formed at a plurality of circumferential positions of a side portion of the rotary-tank mounting wall 122, and a plurality of engaging slots 128 which extend in the axial direction 113 to movably receive and hold or engage and hold the respective engaging claw portions 127 are formed at the corresponding positions of the rotary tank 108.

The discharge port of the fuel pump unit 101 and the inlet of the fuel filter unit 102 are connected to each other by means of a flexible tube 105, and the outlet of the fuel filter unit 102 is connected to another flexible tube 107 having a joint 106 at its extending end, whereby fuel in which foreign matter has been filtered out is supplied to an internal combustion engine such as an automotive engine via the fuel discharge passage portion 120.

The fuel supply apparatus of Patent Document 1 is placed in abutment with the bottom side of the fuel tank, but if the fuel tank is formed of, for example, a molded resin product, the fuel tank is inferior in dimension accuracy and is easily deformed by the influence of the fuel temperature inside the fuel tank. This leads to the problem that since the position of the bottom side of the fuel tank easily varies so that the liquid level of the fuel easily varies, it is difficult to ensure stable operation of the fuel pump. It is to be noted that the fuel supply apparatus is formed to expand and shorten by means of the urging force of an elastic member such as a coiled spring, but in the case where the amount of deformation of the fuel tank is large, the degree of freedom of spring design such as spring constant becomes low in that such deformation cannot be easily absorbed by only the elastic member such as a coiled spring, so that the accuracy of the elastic member to follow the deformation is limited.

In addition, the fuel supply apparatus of Patent Document 1 is constructed in such a manner that the guide tube portions 124 are formed in the inside of the rotary tank 108 and the guide portions 125 capable of being fitted into the respective guide tube portions 124 are formed on the side portion of the rotary-tank mounting wall 122, and the elastic member 126 such as a coiled spring is interposed between the guide tube portions 124 and the guide portions 125 to expansibly support the rotary-tank mounting wall 122 and the rotary tank 108 by the elastic force of the elastic member 126. This construction entails a complicated structure and an increase in manufacturing cost due to an increase in the number of component parts. Furthermore, the setting of the elastic modulus of the coiled spring needs to be made variously different for different uses, and in addition, the fatigue of the spring itself must be taken into account. Accordingly, it is extremely difficult to design a fuel supply apparatus which can stand up to long hours of practical use.

In addition, the fuel supply apparatus of Patent Document 1 has the problem of being inferior in ease of assembly in the fuel tank. Namely, during the assembly of a fuel tank lid unit, first of all, the filter-integrated pump 103 is accommodated into the rotary tank 108, and the filter-integrated pump 103 and the rotary tank 108 are integrated with each other with the distance between the suction port of the fuel pump unit 101 at the bottom of the filter-integrated pump 103 and the bottom of the rotary tank 108 held at a predetermined value by engaging dent grooves provided in the rotary tank 108 with receiving members provided on the filter-integrated pump 103 and by engaging hole portions provided in the rotary tank 108 with engaging claw portions provided on the filter-integrated pump 103.

Furthermore, the joint 106 provided at the extending end of the flexible tube 107 is connected to the inside end of the fuel discharge passage portion 120 inserted through the fuel tank lid 119, and although not shown, a joint provided at an extending end of a flexible tube is connected to an inside end of a fuel return passage portion which is inserted through the fuel tank lid 119, and during this state, the rotary-tank mounting wall 122 is inserted into the gap between the filter-integrated pump 103 and the rotary tank 108. At this time, the respective guide portions 125 are slidably fitted into the guide tube portions 124 formed at the plurality of circumferential positions in the inside of the rotary tank 108 with the elastic member 126 such as a coiled spring inserted therebetween. Accordingly, the fuel supply apparatus of Patent Document 1 is complicated in assembly and inferior in operability.

SUMMARY OF THE INVENTION

The invention has been made to solve the above-described problems, and provides a fuel supply apparatus which is capable of realizing stable fuel supply by following the positional variations of the bottom side of a fuel tank by means of a simple and inexpensive construction, and which is improved in ease of assembly in the fuel tank.

A fuel supply apparatus according to the invention includes: a fuel tank lid unit fitted in a tank opening of a fuel tank, the lid unit having a fuel discharge passage portion through which to discharge fuel inside the fuel tank to an outside thereof and a guide tube portion disposed to extend in a direction inward of the fuel tank; a fuel pump body having a filter-integrated pump in which a fuel pump and a fuel filter are integrally formed and a fuel reservoir having a bottom capable of coming into abutment with a bottom side of the fuel tank, the filter-integrated pump being integrally accommodated in the fuel reservoir, the fuel inside the fuel tank being transferred under pressure to an internal combustion engine via the fuel discharge passage portion; a sliding tube portion disposed to extend from the fuel pump body toward the tank opening and expansibly fitted onto the guide tube portion; an air-tight member disposed in a sliding portion between the guide tube portion and the sliding tube portion; and a pressure regulator secured to the fuel pump body and operative to regulate a pressure of the fuel discharged from the fuel discharge passage portion to a predetermined pressure, the fuel pump body being operative to travel to follow the bottom side of the fuel tank by means of an urging force generated on the basis of a pressure regulated by the pressure regulator, according to depthwise variations of the bottom side of the fuel tank.

According to the invention, when the tank bottom travels toward or away from the tank opening, the sliding tube portion travels to follow the tank bottom while sliding on the guide tube portion owing to the urging force generated on the basis of the pressure of the fuel inside the fuel pump body. Accordingly, it is possible to obtain a fuel supply apparatus which is capable of following the positional variations of the bottom side of the fuel tank by mean of a simple construction and which is improved in terms of ease of assembly in the fuel tank.

BRIEF DESCRIPTION OF THE DRAWINGS

The invention will become more readily appreciated and understood from the following detailed description of preferred embodiments of the invention when taken in conjunction with the accompanying drawings, in which.

DETAILED DESCRIPTION OF THE INVENTION

Figure 1:
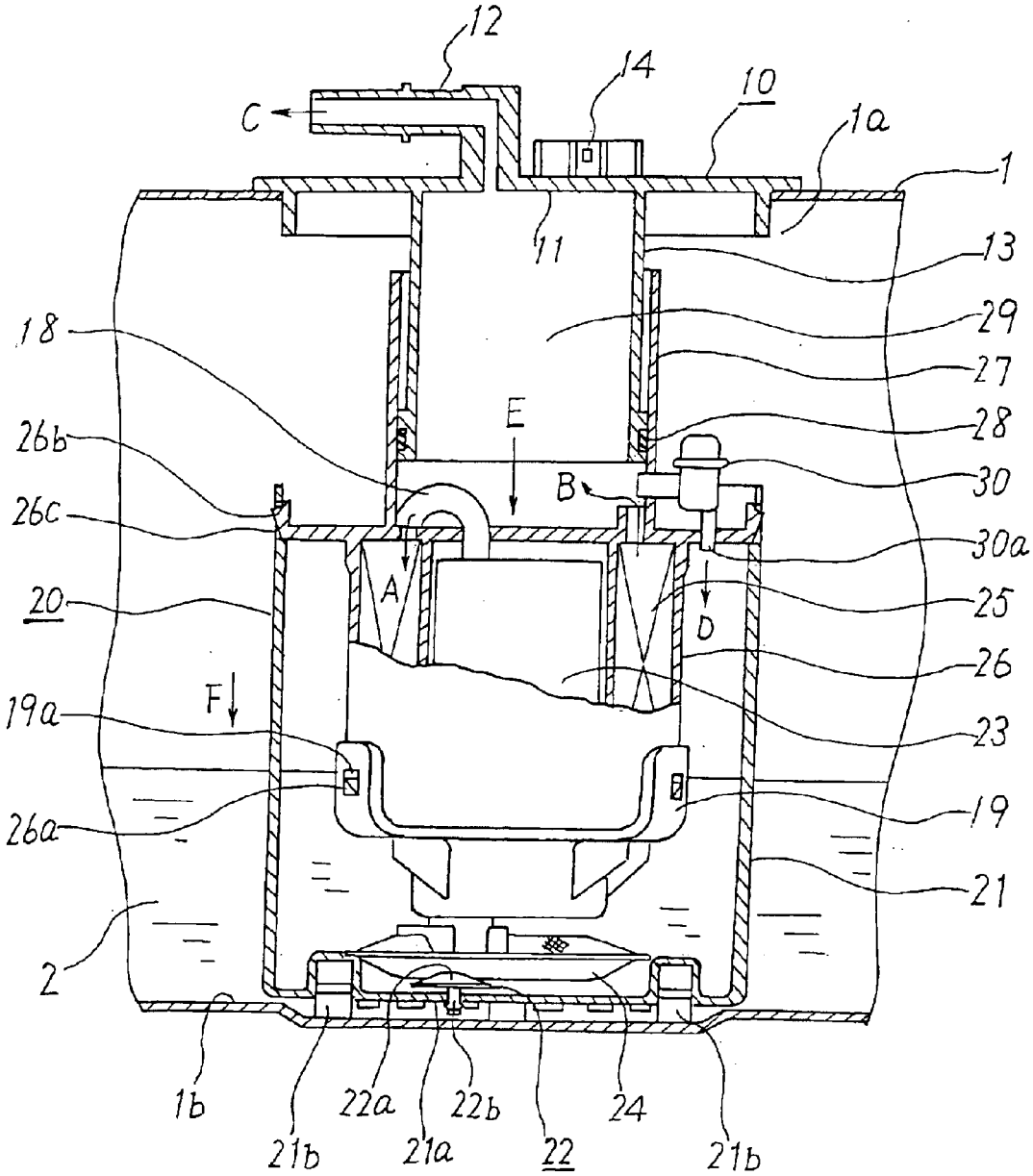
FIG. 1 is a longitudinal cross-sectional view of a fuel supply apparatus according to Embodiment 1 of the invention, showing the case where the position of the bottom side of a fuel tank is shallow.

Preferred embodiments of the invention will be described below in detail with reference to FIGS. 1 to 11. Throughout all the drawings, the same reference numerals denote the same constituent elements and portions.

Embodiment 1

Figure 2:
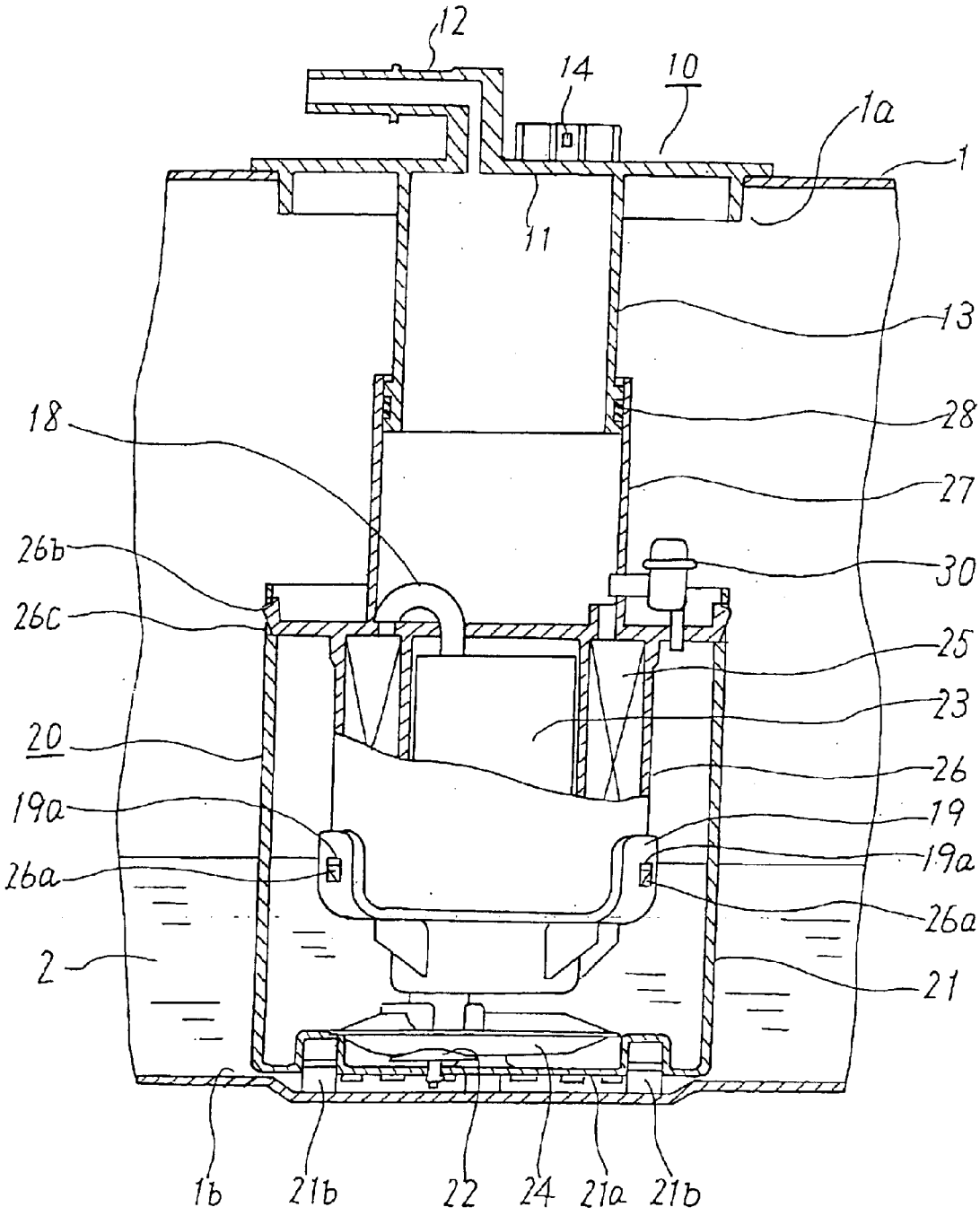
FIG. 2 is a longitudinal cross-sectional view of the fuel supply apparatus according to Embodiment 1 of the invention, showing the case where the position of the bottom side of the fuel tank is deep.
Figure 3:
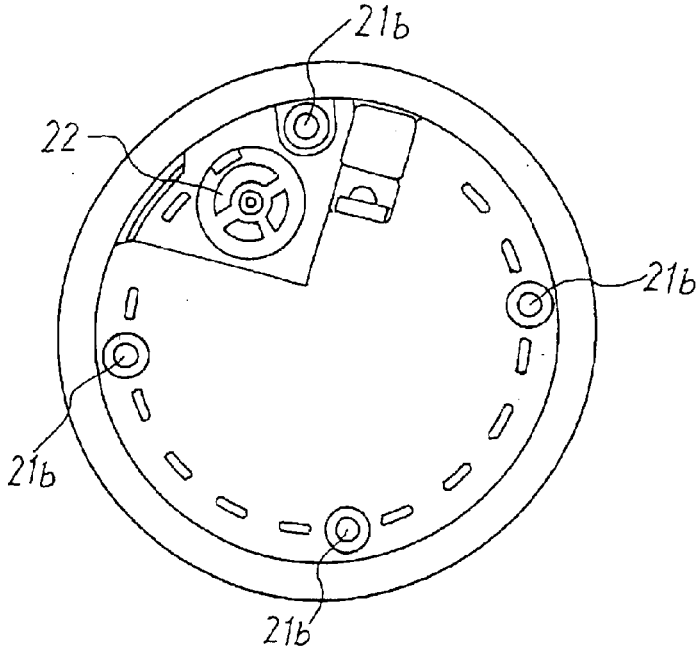
FIG. 3 is a bottom view of the fuel supply apparatus shown in FIG. 1.
Figure 4:
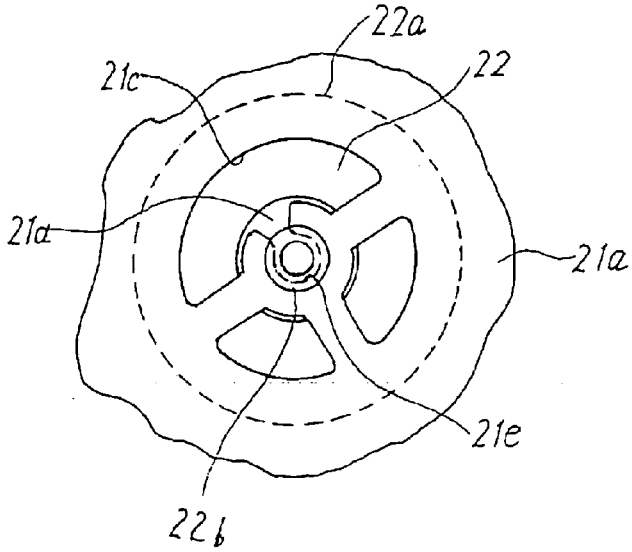
FIG. 4 is an enlarged view of the essential portion of FIG. 3.

FIG. 1 is a longitudinal cross-sectional view of a fuel supply apparatus according to Embodiment 1 of the invention, and shows the case where the position of the bottom side of a fuel tank is shallow, while FIG. 2 is a longitudinal cross-sectional view of the fuel supply apparatus according to Embodiment 1 of the invention, and shows the case where the position of the bottom side of the fuel tank is deep. FIG. 3 is a bottom view of the fuel supply apparatus shown in FIG. 1, FIG. 4 is an enlarged view of the essential portion of FIG. 3, and FIG. 5 is an enlarged view of an air-tight member shown in FIG. 1.

Referring to FIG. 1, the fuel supply apparatus includes a fuel tank lid unit 10 which is externally fitted in a tank opening 1*a* formed in a fuel tank 1, and a fuel pump body 20 which is disposed in the fuel tank 1 so that the bottom side of the fuel pump body 20 can come into abutment with a tank bottom 1*b* and which stably discharges and supplies fuel 2 from the fuel tank 1 to an internal combustion engine such as an automotive engine outside the fuel tank 1. The fuel tank lid unit 10 includes a lid portion 11 which closes and fixes the tank opening 1*a* with a packing by means of fixing means which is not shown, a fuel discharge passage portion 12 which extends through the lid portion 11 and supplies the fuel 2 from the fuel tank 1 to the internal combustion engine such as an automotive engine, a guide tube portion 13 disposed to extend into the inside of the fuel tank 1, and an electric power supply terminal 14 through which to supply electric power to a fuel pump which will be described later.

The fuel pump body 20 includes a fuel reservoir 21 for storing a sucked portion of the fuel 2 inside the fuel tank 1, a check valve 22 which is made of a molded rubber product formed in, for example, an umbrella-like shape and is disposed at a bottom 21*a* of the fuel reservoir 21 in order to prevent the fuel inside the fuel reservoir 21 from flowing into the fuel tank 1, a fuel pump 23 which sucks the fuel inside the fuel reservoir 21 and generates a discharge pressure, a suction filter 24 which filters out foreign matter in the fuel 2 inside the fuel tank 1 which is to be sucked into the fuel pump 23, a fuel filter 25 which filters the fuel discharged from the fuel pump 23, a filter case 26 which accommodates the fuel filter 25, and a sliding tube portion 27 which is disposed to extend upward from the filter case 26 and is slidably fitted onto the guide tube portion 13.

Figure 5:
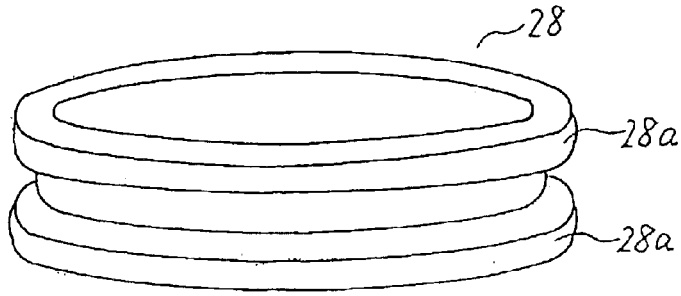
FIG. 5 is an enlarged view of an air-tight member shown in FIG. 1.

An air-tight member 28 which is made of a molded rubber product having lip-shaped portions 28*a* formed in a plurality of steps as shown in FIG. 5 is inserted into the sliding portion between the guide tube portion 13 and the guide roller 27 to facilitate both axial and circumferential sliding therebetween as well as to seal the sliding portion to prevent the fuel from leaking from a storage chamber 29 formed by the guide tube portion 13 and the guide roller 27. A pressure regulator 30 which regulates the pressure of the fuel of the storage chamber 29 discharged from the fuel pump 23 to a predetermined pressure is provided in a portion of the guide roller 27. This pressure regulator 30 may be of a known type such as that shown in FIG. 1 of JP-A-2001-75652. A plurality of shock absorbing members 21*b* each of which is made of a molded rubber product and is placed in abutment with the tank bottom 1*b* of the fuel tank 1 are fixed to the bottom side of the fuel reservoir 21.

The fuel pump 23 held by a pump holding member 19 is inserted into a hollow portion of a cylindrical filter case 26 from below, and is removably held in such a manner that a plurality of first engaging portions 26*a* (for example, projections) disposed to project from a peripheral portion of the filter case 26 are respectively brought into engagement with holes 19*a* in the pump holding member 19. The filter case 26 is removably held in such a manner that a plurality of second engaging portions 26*b* (made of, for example, projections) which are respectively provided on edge portions of a top plate of the filter case 26 are respectively brought into engagement with cut-out holes 26*b* provided in a top portion of the fuel reservoir 21.

The check valve 22 which is made of a molded rubber product formed in an umbrella-like shape and is generally called an umbrella valve includes, as shown in the enlarged view of FIG. 4, an umbrella portion 22*a* which closes an inflow hole 21*c* provided in the bottom 21*a* of the fuel reservoir 21, and a grip portion 22*b* which is inserted and held in a holding hole 21*e* having a cut-out portion 21*d*. The check valve 22 can be easily secured to the bottom 21*a* of the fuel reservoir 21, because the check valve 22 is held by the holding hole 21*e* merely by inserting the grip portion 22*b* of the check valve 22 into the holding hole 21*e* through the cut-out portion 21*d*.

The operation of the fuel supply apparatus which is constructed in the above-mentioned manner according to Embodiment 1 of the invention will be described below.

When the fuel supply apparatus is mounted in the fuel tank 1 through the tank opening 1*a*, the fuel pump body 20 is placed in abutment with the tank bottom 1*b* through the shock absorbing members 21*b*, and during this state, the fuel 2 inside the fuel tank 1 flows into the fuel reservoir 21 through the check valve 22.

It is to be noted that the check valve 22 is constructed to allow the fuel 2 inside the fuel tank 1 to flow into the fuel reservoir 21, but not to allow the fuel inside the fuel reservoir 21 to flow into the fuel tank 1.

Then, when electric power is supplied through the electric power supply terminal 14 to activate the fuel pump 23, the fuel inside the fuel reservoir 21 is sucked through the suction filter 24 secured to a suction side of the fuel pump 23. At this time, the suction filter 24 removes comparatively large foreign matter contained in the fuel.

Subsequently, the fuel discharged from a discharge port (not shown) of the fuel pump 23 is transferred to the fuel filter 25 (in the direction of an arrow A in FIG. 1) via a connecting pipe 18 which connects the fuel pump 23 and the fuel filter 25. While the fuel is flowing in the inside of the fuel filter 25, foreign matter contained in the fuel, such as wear particles of a brush of an electric motor (not shown) which constitutes the fuel pump 23, is filtered out.

The fuel discharged through the fuel filter 25 flows into the storage chamber 29 (in the direction of an arrow B), and is transferred from the fuel discharge passage portion 12 to the internal combustion engine such as an automotive engine via a fuel hose which is not shown (in the direction of an arrow C).

It is to be noted that the storage chamber 29 is provided with the pressure regulator 30 which regulates the pressure of the fuel discharged from the fuel filter 25 to a predetermined pressure, whereby the fuel inside the storage chamber 29 is regulated to the predetermined pressure (generally, a pressure of 3 atmospheres in order to meet the requirements of the internal combustion engine) and excess fuel flows into the fuel reservoir 21 through a discharge port 30*a* of the pressure regulator 30 and is stored in the fuel reservoir 21 (in the direction of an arrow D).

In the above-described operation, since the sliding tube portion 27 is formed for sliding movement with respect to the guide tube portion 13 and the fuel of the storage chamber 29 is pressurized at a predetermined pressure, when the tank bottom 1*b* travels in a direction away from the tank opening 1*a* (the fuel tank 1 becomes deep) under the influence of the temperature of the fuel 2 inside the fuel tank 1, the bottom side of the fuel pump body 20 travels away from abutment with the tank bottom 1*b*. Accordingly, an urging force based on the pressure of the fuel inside the storage chamber 29 is generated in the direction of an arrow E and causes the fuel pump body 20 to travel in the direction of an arrow F by means of the sliding between the guide tube portion 13 and the sliding tube portion 27, whereby the fuel pump body 20 travels to a position where the bottom side thereof is again brought into abutment with the tank bottom 1*b*. This state is shown in FIG. 2.

It is to be noted that even if the tank bottom 1*b* of the fuel tank 1 is away from the tank opening 1*a* owing to manufacturing variations of the fuel tank 1, the fuel pump body 20 travels to follow the tank bottom 1*b* in a similar manner, whereby the fuel pump body 20 can be stably clamped between the tank opening 1*a* of the fuel tank 1 and the tank bottom 1*b*.

In the above description, the excess fuel is directly stored in the fuel reservoir 21, but it is also preferable to generate a negative pressure by causing the excess fuel to flow into, for example, a jet pump disclosed in JP-A-2001-132568, and cause the fuel 2 inside the fuel tank 1 to flow into the fuel reservoir 21 by means of the negative pressure.

It is also preferable to provide the fuel reservoir 21 with a fuel level gauge, such as that disclosed in JP-A-2001-132568, for detecting the amount of fuel in the fuel tank 1.

In the fuel supply apparatus constructed in the above-described manner according to Embodiment 1 of the invention, when the tank bottom 1*b* travels toward or away from the tank opening 1*a*, the sliding tube portion 27 travels to follow the tank bottom 1*b* while sliding on the guide tube portion 13 owing to the urging force generated on the basis of the pressure of the fuel inside the storage chamber 29 of the fuel pump body 20. Accordingly, there is no need for an elastic member such as coiled spring, and it is possible to obtain a fuel supply apparatus capable of accurately coping with the positional variations of the tank bottom 1*b* by mean of a simple construction. During assembly, it is possible to cope with the mounting of the fuel pump 23 in the filter case 26 and the mounting of the filter case 26 in the fuel reservoir 21 by means of an extremely simple construction, and the fuel tank lid unit 10 can be fitted onto the fuel pump body 20 merely by inserting the guide tube portion 13 into the sliding tube portion 27 from above. Accordingly, it is possible to obtain a fuel supply apparatus which is improved in terms of ease of assembly. In addition, since the fuel is stored in the fuel reservoir 21, even when a vehicle inclines, the fuel pump 23 can positively transfer the fuel sucked into the fuel reservoir 21 to the internal combustion engine such as an automotive engine.

Embodiment 2

Figure 6:
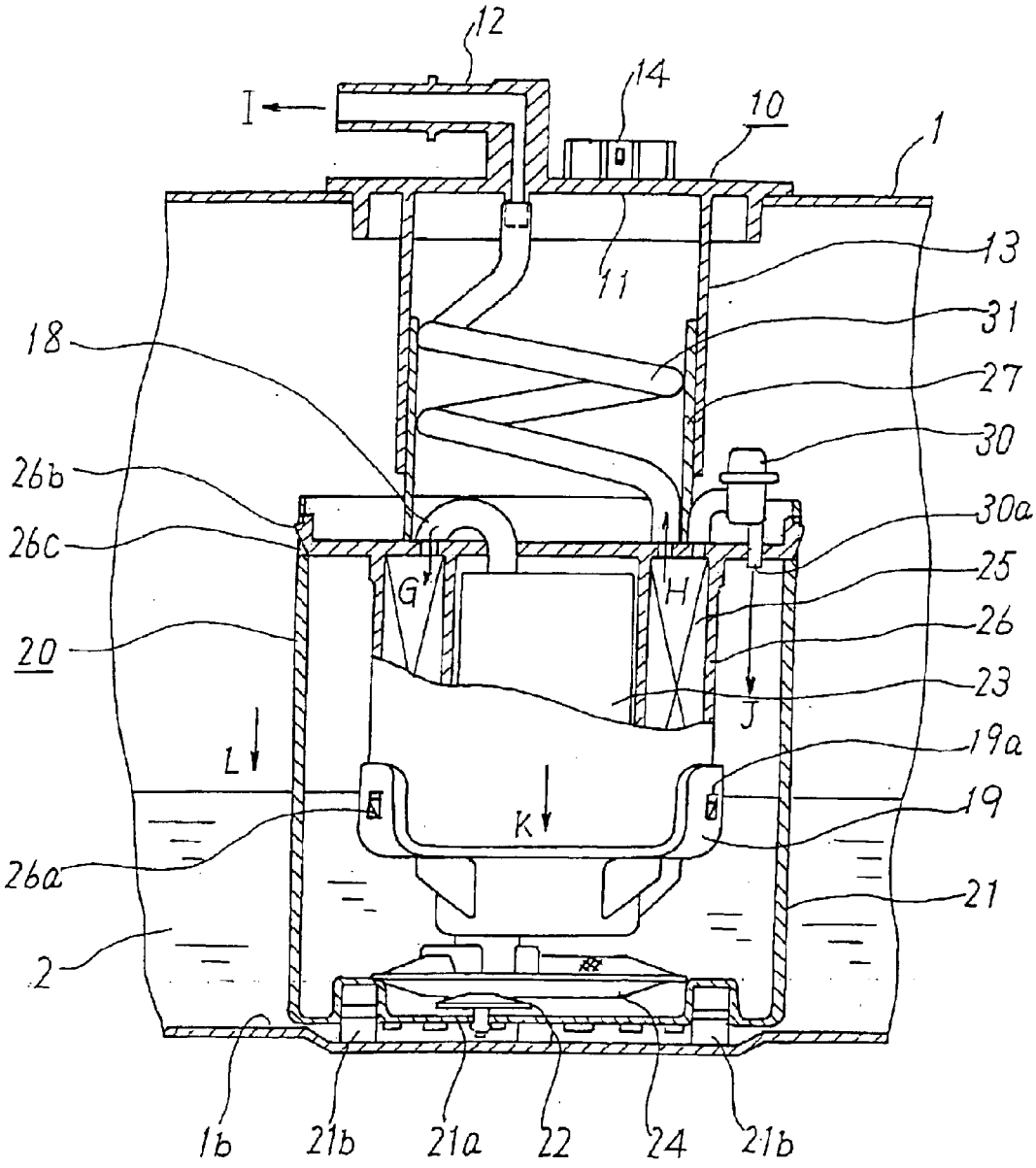
FIG. 6 is a longitudinal cross-sectional view of a fuel supply apparatus according to Embodiment 2 of the invention, showing the case where the position of the bottom side of the fuel tank is shallow.
Figure 7:
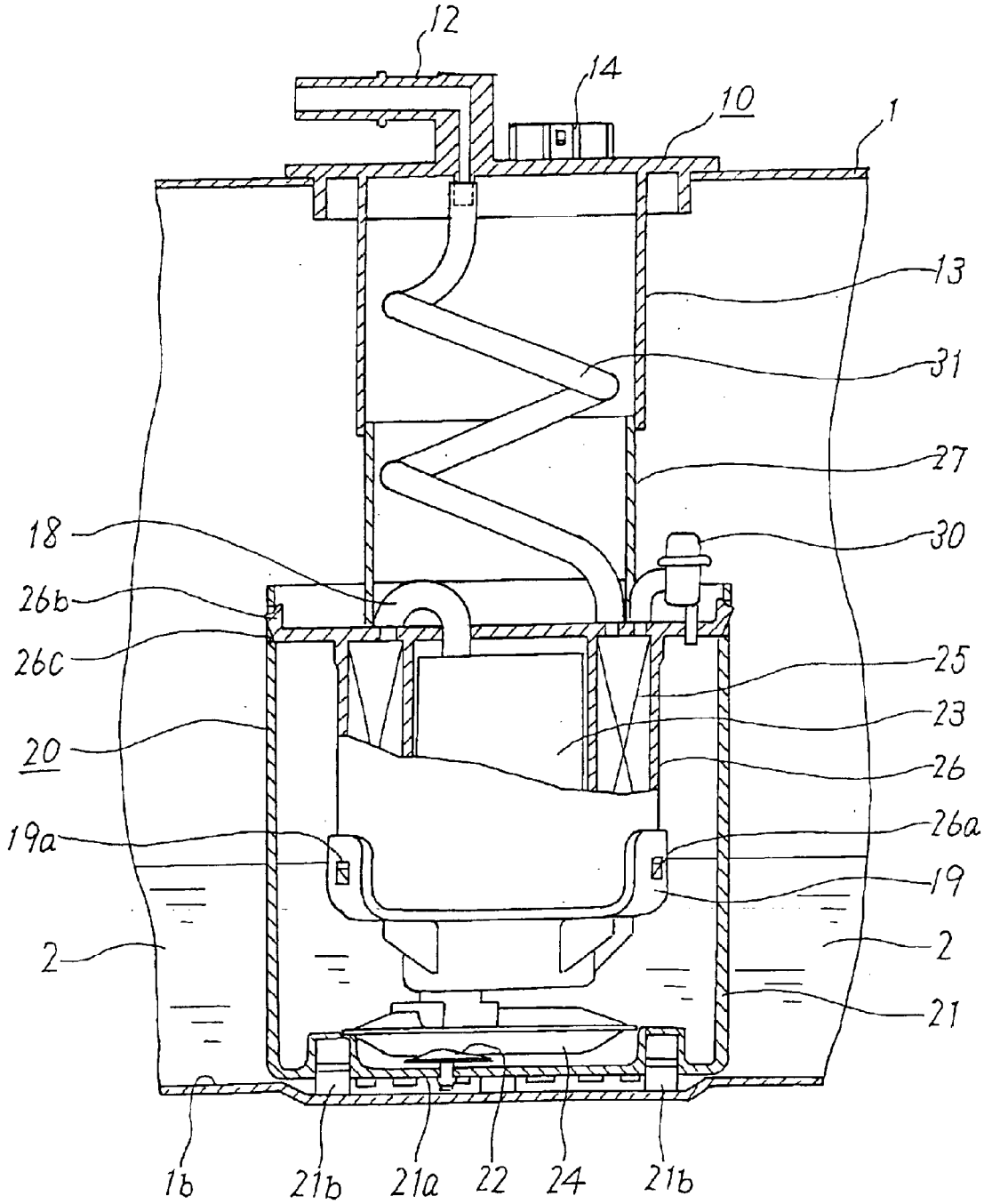
FIG. 7 is a longitudinal cross-sectional view of the fuel supply apparatus according to Embodiment 2 of the invention, showing the case where the position of the bottom side of the fuel tank is deep.

FIG. 6 is a longitudinal cross-sectional view of a fuel supply apparatus according to Embodiment 2 of the invention, and shows the case where the position of the bottom side of the fuel tank is shallow, while FIG. 7 is a longitudinal cross-sectional view of the fuel supply apparatus according to Embodiment 2 of the invention, and shows the case where the position of the bottom side of the fuel tank is deep. In FIGS. 6 and 7, the same constituent elements and portions as those used in Embodiment 1 are denoted by the same reference numerals. The following description focuses on points different from Embodiment 1. The discharge port of the fuel filter 25 and the fuel discharge passage portion 12 are arranged to directly communicate with each other by means of a connecting member 31 which is formed in a coiled shape, whereby after the fuel discharged from the fuel filter 25 has flown into the connecting member 31 (in the direction of an arrow H), the fuel is transferred from the fuel discharge passage portion 12 to the internal combustion engine such as an automotive engine via a fuel hose which is not shown (in the direction of an arrow I).

The filter case 26 is provided with the pressure regulator 30 which regulates the pressure of the fuel discharged from the fuel filter 25 to a predetermined pressure, whereby the fuel inside the filter case 26 is regulated to the predetermined pressure and excess fuel flows into the fuel reservoir 21 through the discharge-port 30*a* of the pressure regulator 30 and is stored in the fuel reservoir 21 (in the direction of the arrow I).

The sliding tube portion 27 provided on the filter case 26 is slidably inserted in the guide tube portion 13 provided on the fuel tank lid unit 10 and the connecting member 31 is expansibly formed in a coiled shape, and the fuel inside the filter case 26 is pressurized to a predetermined pressure. Accordingly, in the above-described operation, when the tank bottom 1*b* travels away from the tank opening 1*a* under the influence of the temperature of the fuel 2 inside the fuel tank 1, the pressure of the fuel itself which flows in the coiled connecting member 31 expands the connecting member 31, and an urging force based on the force of this expansion is generated in the direction of an arrow K and causes the fuel pump body 20 to travel in the direction of an arrow L to follow the tank bottom 1*b*. This state is shown in FIG. 7. Incidentally, although the connecting member 31 is formed in a coiled shape, the connecting member 31 may be formed in an approximately S-like shape, a zigzag shape or any other shape that enables an expanding force to work on itself when a high-pressure fuel flows in its inside.

Embodiment 3

Figure 8:
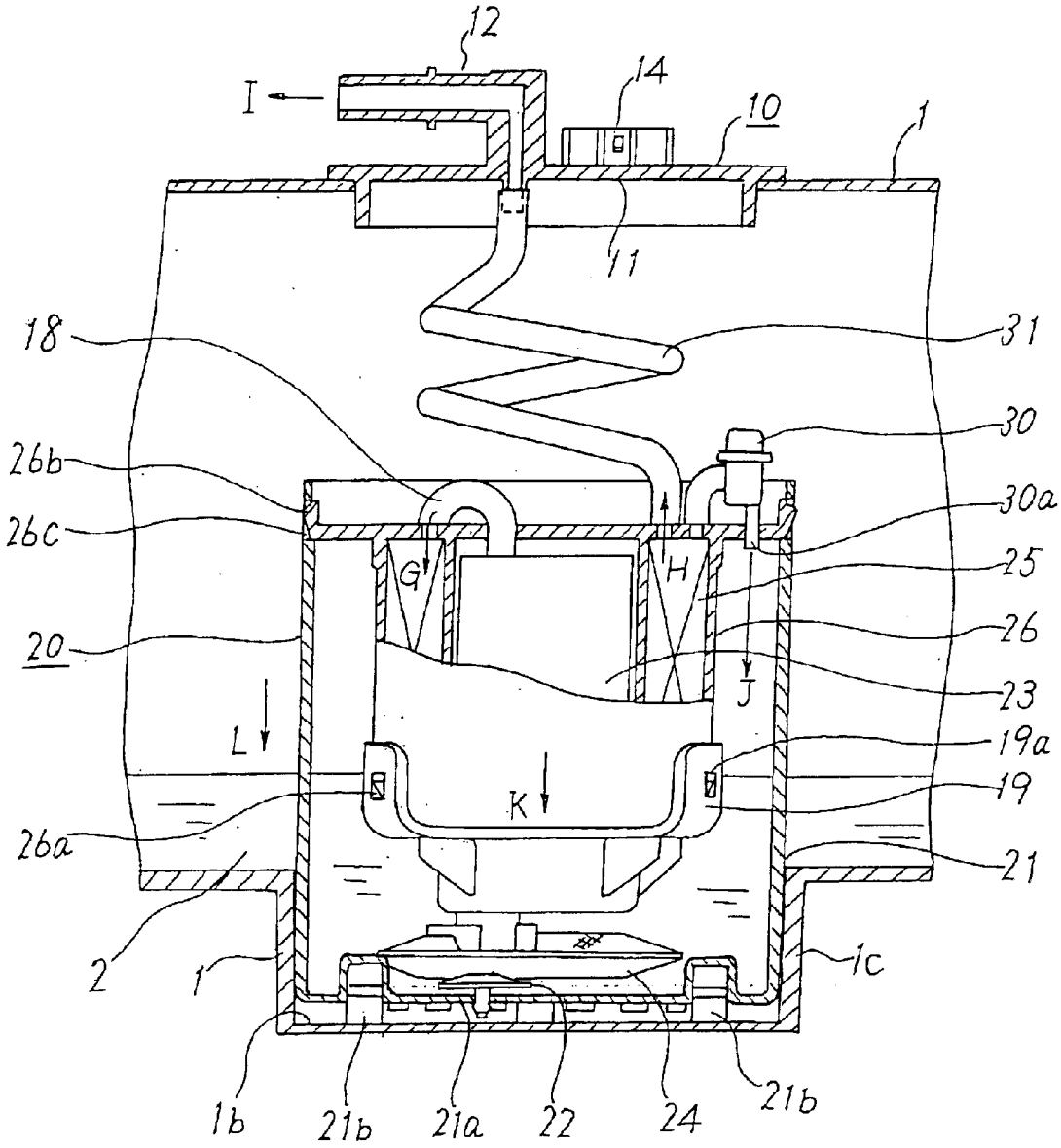
FIG. 8 is a longitudinal cross-sectional view of a fuel supply apparatus according to Embodiment 3 of the invention, showing the case where the position of the bottom side of the fuel tank is shallow.
Figure 9:
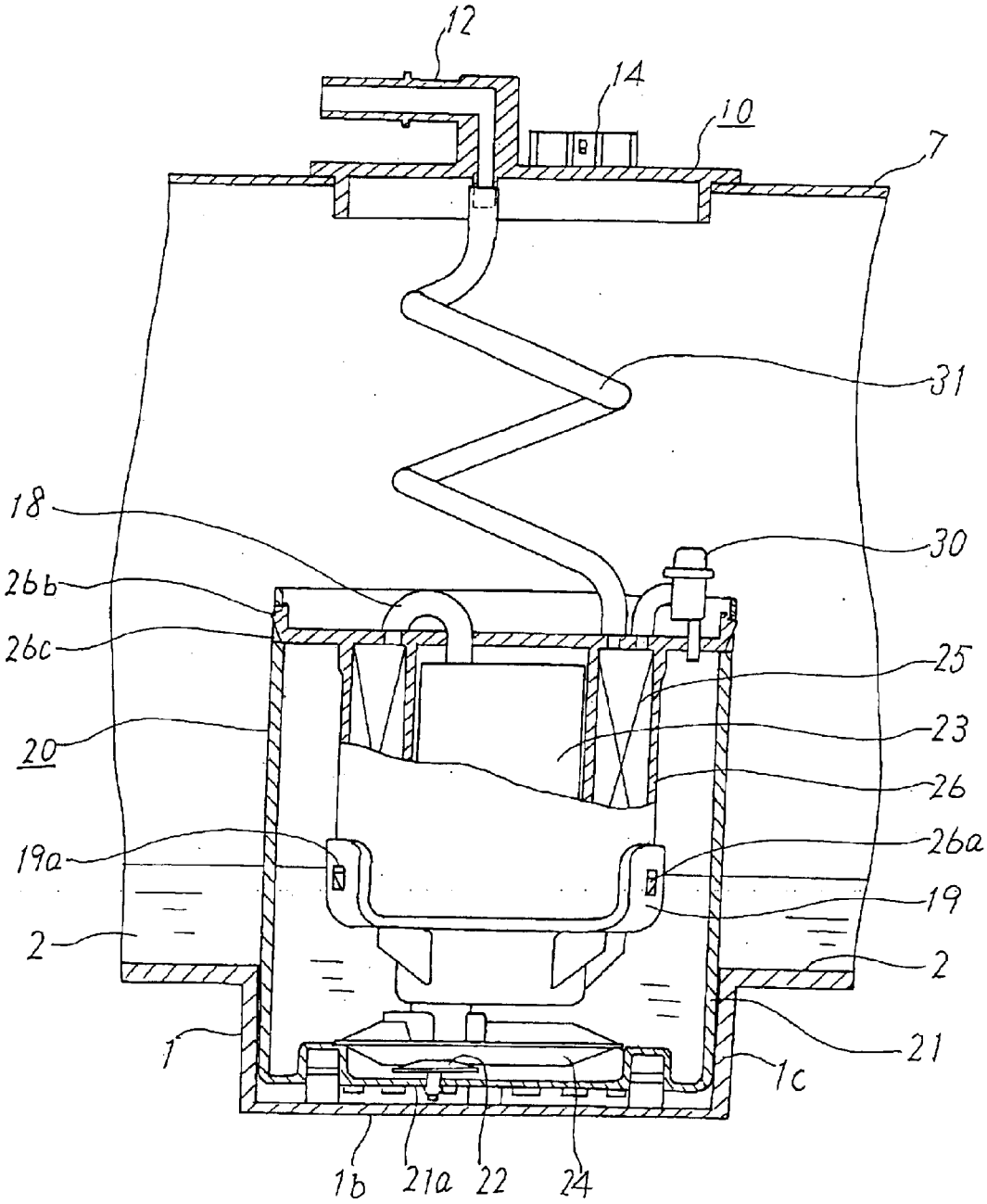
FIG. 9 is a longitudinal cross-sectional view of the fuel supply apparatus according to Embodiment 3 of the invention, showing the case where the position of the bottom side of the fuel tank is deep.

A fuel supply apparatus according to Embodiment 3 is a modification of Embodiment 2, and FIG. 8 is a longitudinal cross-sectional view of the fuel supply apparatus, and shows the case where the position of the bottom side of the fuel tank is shallow, while FIG. 9 is a longitudinal cross-sectional view of the fuel supply apparatus, and shows the case where the position of the bottom side of the fuel tank is deep. In FIGS. 8 and 9, the same constituent elements and portions as those used in Embodiment 2 are denoted by the same reference numerals. The following description focuses on points different from Embodiment 2. The tank bottom 1*b* of the fuel tank 1 is formed to have a cavity portion 1*c*, and the bottom of the fuel pump body 20 is fitted in the cavity portion 1*c* so that the cavity portion 1*c* serves as a guide portion for guiding the vertical movement of the fuel pump body 20. In this construction, the guide tube portion 13 and the sliding tube portion 27 are omitted. It is to be noted that the depthwise dimension of the cavity portion 1*a* of the tank bottom 1*b* of the fuel tank 1 needs only to be made at least 40 mm, because the range of vertical movement of the tank bottom 1*b* due to heat is +10–20 mm. Since Embodiment 3 is the same as Embodiment 2 in operation, the description of the operation of Embodiment 3 is omitted.

Embodiment 4

Figure 10:
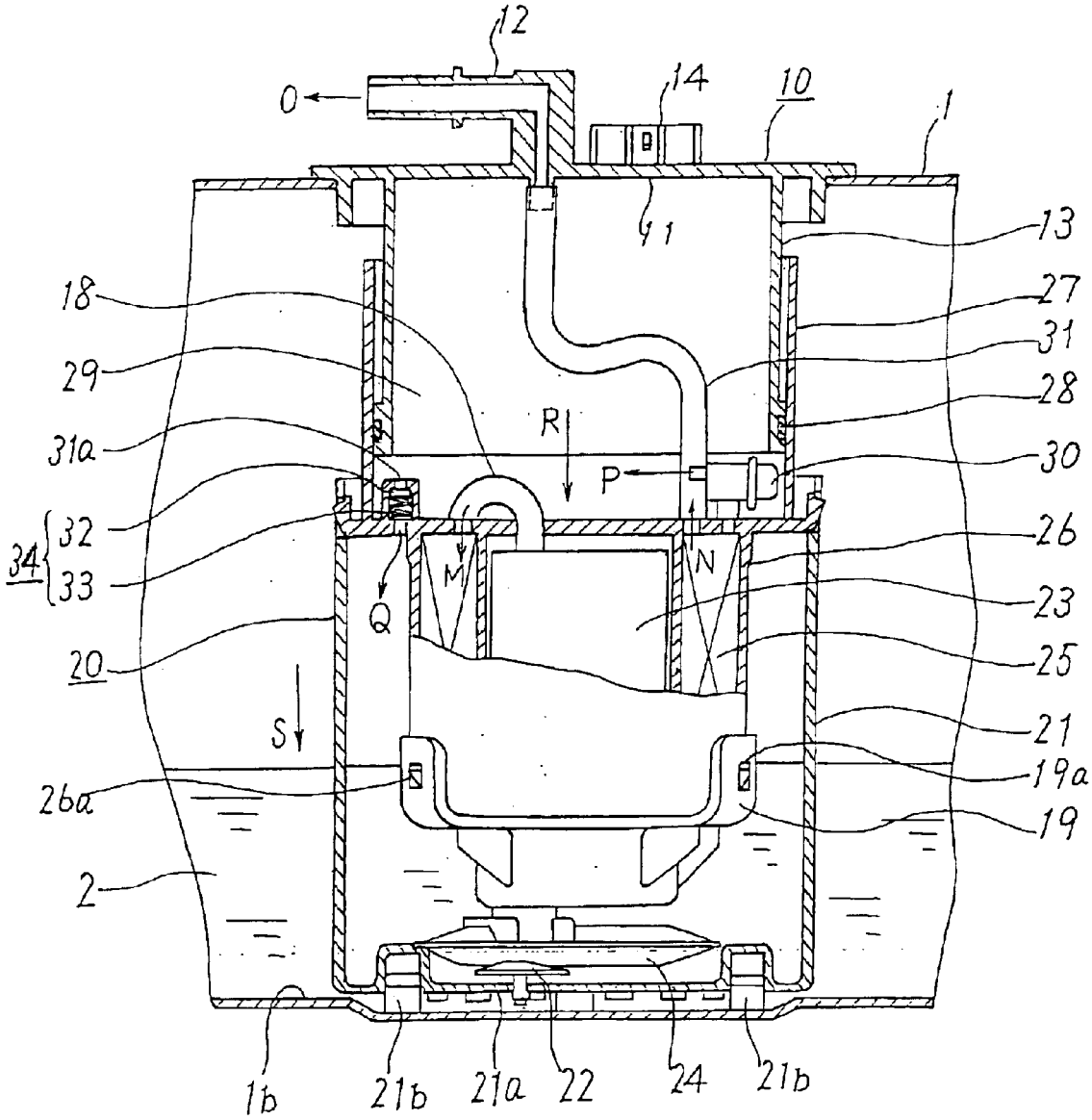
FIG. 10 is a longitudinal cross-sectional view of a fuel supply apparatus according to Embodiment 4 of the invention, showing the case where the position of the bottom side of the fuel tank is shallow.
Figure 11:
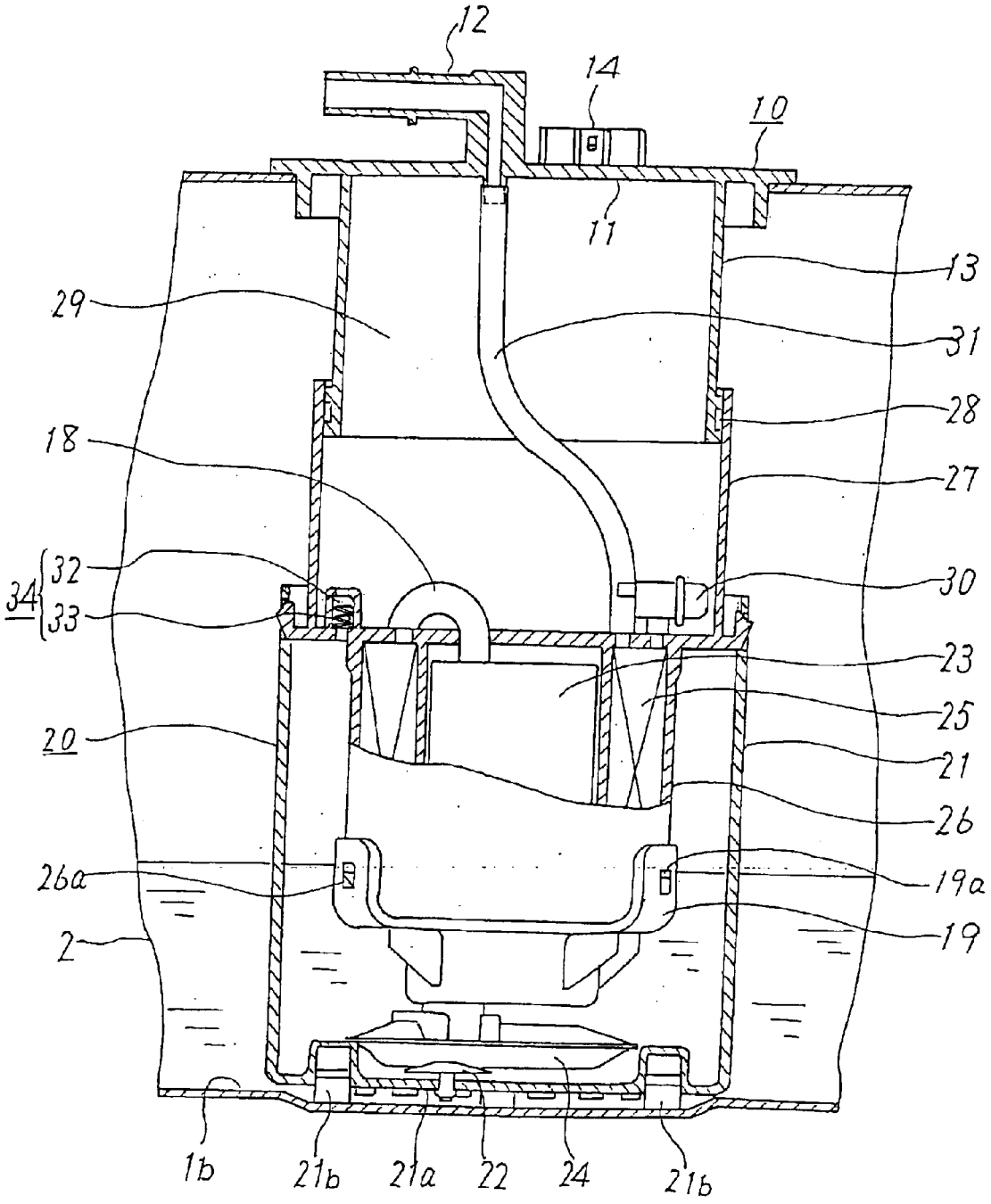
FIG. 11 is a longitudinal cross-sectional view of the fuel supply apparatus according to Embodiment 4 of the invention, showing the case where the position of the bottom side of the fuel tank is deep.
Figure 12:
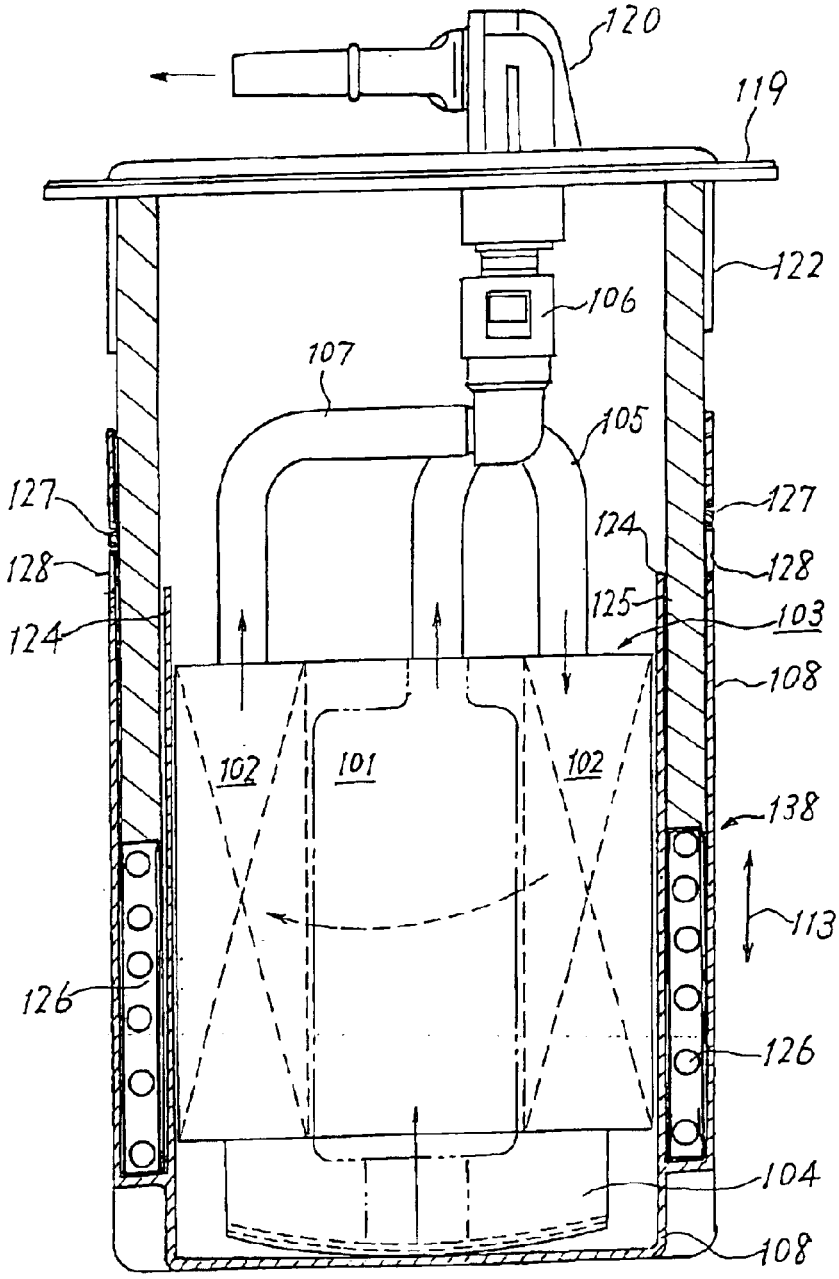
FIG. 12 is a longitudinal cross-sectional view schematically shows a fuel supply apparatus according to a related art.

FIG. 10 is a longitudinal cross-sectional view of a fuel supply apparatus according to Embodiment 4 of the invention, and shows the case where the position of the bottom side of the fuel tank is shallow, while FIG. 11 is a longitudinal cross-sectional view of the fuel supply apparatus according to Embodiment 4 of the invention, and shows the case where the position of the bottom side of the fuel tank is deep. In FIGS. 10 and 11, the same constituent elements and portions as those used in Embodiment 1 are denoted by the same reference numerals. The following description focuses on points different from Embodiment 1. The pressure regulator 30 is secured to the outlet of the filter case 26 so that the fuel inside the filter case 26 is regulated to a predetermined pressure and excess fuel is discharged into the storage chamber 29. When the pressure inside the storage chamber 29 reaches a pressure of 0.1 to 0.2 atmospheres, a valve mechanism portion 34 operative to cause a valve 32 to open against a spring 33 is activated, and the fuel discharged from the valve mechanism portion 34 is stored into the fuel reservoir 21. The fuel pump body 20 and the fuel tank lid unit 10 are connected to each other by means of the connecting member 31 which is formed in an approximately S-like shape. The constructions of the other constituent elements and portions are similar to those of the corresponding ones of Embodiment 1 mentioned above.

The operation of the fuel supply apparatus according to Embodiment 4 will be described below.

The fuel discharged from a discharge port (not shown) of the fuel pump 23 is transferred to the fuel filter 25 (in the direction of an arrow M in FIG. 10) via a connecting pipe 18 which connects the fuel pump 23 and the fuel filter 25, and foreign matter contained in the fuel is filtered out in the inside of the fuel filter 25.

Then, the fuel discharged through the fuel filter 25 flows into the connecting member 31 (in the direction of an arrow N), and is transferred from the fuel discharge passage portion 12 to the internal combustion engine such as an automotive engine via a fuel hose which is not shown (in the direction of an arrow 0). At this time, the discharged fuel is held at a predetermined pressure (for example, a pressure of 3 atmospheres) by the pressure regulator 30.

The excess fuel discharged from the pressure regulator 30 flows into the storage chamber 29 (in the direction of an arrow P), and is stored into the storage chamber 29.

When the pressure inside the storage chamber 29 changes from, for example, a pressure of 0.1 atmosphere to a predetermined pressure such as a pressure of 0.2 atmospheres, the pressure is applied to the valve 32 through an opening 31*a* in the valve mechanism portion 34 and causes the valve 32 to open against the spring 33, whereby the fuel inside the storage chamber 29 is allowed to flow into the fuel reservoir 21 (in the direction of an arrow Q). In this manner, the pressure inside the storage chamber 29 is held at the above-mentioned pressure.

In the above-mentioned manner, since the sliding tube portion 27 is formed for sliding movement with respect to the guide tube portion 13 and the fuel of the storage chamber 29 is pressurized at the predetermined pressure, when the tank bottom 1*b* travels away from the tank opening 1*a* under the influence of the temperature of the fuel 2 inside the fuel tank 1, an urging force based on the pressure of the fuel inside the storage chamber 29 is generated in the direction of an arrow R and causes the fuel pump body 20 to travel in the direction of an arrow S, whereby the fuel pump body 20 travels to follow the tank bottom 1*b*. This state is shown in FIG. 11.

In the fuel supply apparatus according to Embodiment 4 of the invention, when the tank bottom 1*b* travels toward or away from the tank opening 1*a*, the connecting member 31 expansibly travels to follow the tank bottom 1*b* owing to the urging force generated on the basis of the pressure of the excess fuel discharged from the pressure regulator 30, whereby the fuel pump body 20 can follow the travel of the tank bottom 1*b* at a low pressure of, for example, 0.1 to 0.2 atmospheres. Accordingly, the fuel supply apparatus according to Embodiment 4 is particularly suitable for use in a lightweight fuel tank formed of resin, and the like.

What is claimed is:

1. A fuel supply apparatus comprising:

a lid unit fitted in a tank opening of a fuel tank, the lid unit having a fuel discharge passage portion through which to discharge fuel inside the fuel tank to an outside thereof and a guide tube portion disposed to extend in a direction inward of the fuel tank;

a fuel pump body having a filter-integrated pump in which a fuel pump and a fuel filter are integrally formed and a fuel reservoir having a bottom capable of coming into abutment with a bottom side of the fuel tank, the filter-integrated pump being integrally accommodated in the fuel reservoir, the fuel inside the fuel tank being transferred under pressure to an internal combustion engine via the fuel discharge passage portion;

a sliding tube portion disposed to extend from the fuel pump body toward the tank opening and expansibly fitted onto the guide tube portion;

an air-tight member disposed in a sliding portion between the guide tube portion and the sliding tube portion; and a pressure regulator secured to the fuel pump body and operative to regulate a pressure of the fuel discharged from the fuel discharge passage portion to a predetermined pressure, the fuel pump body being operative to travel according to variations in depth of the bottom side of the fuel tank by making use of relative expanding and shortening movements between the guide tube portion and the sliding tube portion, by an urging force generated on the basis of a pressure regulated by the pressure regulator.

2. A fuel supply apparatus according to claim 1, wherein the fuel discharged from the fuel filter is supplied to the fuel discharge passage portion via a storage chamber formed by the guide tube portion and the sliding tube portion, a pressure inside the storage chamber being regulated to a predetermined value by the pressure regulator.

3. A fuel supply apparatus according to claim 1, wherein the fuel discharged from the fuel filter is supplied from an outlet of the fuel filter directly to the fuel discharge passage portion via a connecting member, a pressure at the outlet of the fuel filter being regulated to a predetermined value by the pressure regulator.

4. A fuel supply apparatus according to claim 3, wherein the connecting member is formed in any of coiled, S-like and zigzag shapes.

5. A fuel supply apparatus according to claim 3, wherein excess fuel remaining after the pressure has been regulated by the pressure regulator is supplied via the pressure regulator to a storage chamber formed by the guide tube portion and the sliding tube portion, and a valve mechanism portion is provided in the storage chamber to detect a predetermined pressure inside the storage chamber, and to cause the excess fuel inside the storage chamber to flow into the fuel reservoir.

6. A fuel supply apparatus comprising:

a lid unit fitted in a tank opening of a fuel tank and having a fuel discharge passage portion through which to discharge fuel inside the fuel tank to an outside thereof;

a fuel pump body having a filter-integrated pump in which a fuel pump and a fuel filter are integrally formed and a fuel reservoir having a bottom capable of coming into abutment with a bottom side of the fuel tank, the filter-integrated pump being integrally accommodated in the fuel reservoir, the fuel inside the fuel tank being transferred under pressure to an internal combustion engine via the fuel discharge passage portion;

a pressure regulator secured to the fuel pump body and operative to regulate a pressure of the fuel discharged from the fuel discharge passage portion to a predetermined pressure;

a flexible connecting member through which to supply the fuel discharged from the fuel filter from an outlet of the fuel filter directly to the fuel discharge passage portion; and a cavity portion which is provided in a bottom portion of the fuel tank and into which a bottom portion of the fuel pump body is fitted, the cavity portion serving to guide vertical movements of the fuel pump body, the fuel pump body being operative to travel according to variations in depth of the bottom side of the fuel tank by making use of the guide cavity portion, by an urging force generated on the basis of a pressure regulated by the pressure regulator.

7. A fuel supply apparatus according to claim 1 or 6, wherein the fuel pump is removably integrally held in a filter case having a cylindrical shape by pump holding members provided on the fuel pump to engage, respectively, with first engaging portions arranged in a peripheral portion of the filter case, with the fuel pump inserted in a hollow portion of the filter case.

8. A fuel supply apparatus according to claim 1 or 6, wherein the filter-integrated pump is removably integrally held in the fuel reservoir by second engaging portions.

9. A fuel supply apparatus according to claim 1 or 6, wherein the bottom of the fuel reservoir has an umbrella-shaped check valve which enables the fuel inside the fuel tank to flow into the fuel reservoir and disables the fuel inside the fuel reservoir from flowing out therefrom.

10. A fuel supply apparatus according to claim 1 or 6, wherein excess fuel remaining after the pressure has been regulated by the pressure regulator is made to flow into the fuel reservoir.

11. A fuel supply apparatus according to claim 1 or 6, wherein the fuel reservoir has an inflow hole which is closed by an umbrella portion of the check valve and a holding hole in which a grip portion of the check valve is insertedly held through a cut-out portion of the holding hole.

12. A fuel supply apparatus according to claim 1 or 6, wherein the air-tight member is made of a molded rubber product having a plurality of stacked lip-shaped portions.

13. A fuel supply apparatus according to claim 1 to 6, wherein a plurality of shock absorbing members are respectively provided at the bottom of the fuel reservoir at locations where the plurality of shock absorbing members are placed in abutment with the tank bottom of the fuel tank.

* * * * *